US011344172B2

(12) United States Patent
Xu et al.

(10) Patent No.: US 11,344,172 B2
(45) Date of Patent: May 31, 2022

(54) ROLLER BRUSH ASSEMBLY AND CLEANING DEVICE

(71) Applicant: MIDEA ROBOZONE TECHNOLOGY CO., LTD., Suzhou (CN)

(72) Inventors: Xiaowei Xu, Suzhou (CN); Yuan Chen, Suzhou (CN); Xianmin Wei, Suzhou (CN); Daming Shen, Suzhou (CN)

( * ) Notice: Subject to any disclaimer, the term of this patent is extended or adjusted under 35 U.S.C. 154(b) by 374 days.

(21) Appl. No.: 16/626,873

(22) PCT Filed: Mar. 19, 2019

(86) PCT No.: PCT/CN2019/078666
§ 371 (c)(1),
(2) Date: Dec. 26, 2019

(87) PCT Pub. No.: WO2020/151070
PCT Pub. Date: Jul. 30, 2020

(65) Prior Publication Data

US 2021/0401256 A1 Dec. 30, 2021

(30) Foreign Application Priority Data

Jan. 24, 2019 (CN) ..... 201920125075.0

(51) Int. Cl.
*A47L 11/40* (2006.01)
*A47L 9/04* (2006.01)
(Continued)

(52) U.S. Cl.
CPC ..... *A47L 11/4041* (2013.01); *A46B 5/0037* (2013.01); *A46B 13/001* (2013.01);
(Continued)

(58) Field of Classification Search
CPC ..... A47L 9/04; A47L 11/40; A47L 5/10
See application file for complete search history.

(56) References Cited

U.S. PATENT DOCUMENTS 3,978,539 A * 9/1976 Yonkers ..... A47L 11/4072 15/42
5,664,276 A * 9/1997 Arias ..... A47L 11/4072 15/44
(Continued)

FOREIGN PATENT DOCUMENTS

CN 108201413 A 6/2018
CN 108888177 A 11/2018
(Continued)

OTHER PUBLICATIONS

OA for EP application 19911018.0.
(Continued)

*Primary Examiner* — Michael D Jennings
(74) *Attorney, Agent, or Firm* — Kilpatrick Townsend & Stockton, LLP

(57) ABSTRACT

A roller brush assembly and a cleaning device are provided. The above roller brush assembly is applied in the cleaning device, including: a main roller brush; an electric motor configured to drive the main roller brush to rotate to sweep a surface to be cleaned; and an auxiliary roller brush driven by the main roller brush to rotate and sweep the surface to be cleaned towards the main roller brush.

14 Claims, 2 Drawing Sheets

(51) Int. Cl.

| | |
|---|---|
| ***A46B 5/00*** | (2006.01) |
| ***A46B 13/00*** | (2006.01) |
| ***A46B 13/02*** | (2006.01) |
| ***A47L 11/24*** | (2006.01) |

(52) U.S. Cl.
CPC ..... *A46B 13/02* (2013.01); *A47L 9/0411* (2013.01); *A47L 9/0477* (2013.01); *A47L 9/0488* (2013.01); *A47L 11/24* (2013.01); *A47L 11/4069* (2013.01); *A46B 2200/3033* (2013.01); *A47L 2201/00* (2013.01)

(56) References Cited

U.S. PATENT DOCUMENTS

| | | | | |
|---|---|---|---|---|
| 7,827,653 | B1 * | 11/2010 | Liu | A47L 11/24 15/371 |
| 8,230,540 | B1 * | 7/2012 | Nelson | A47L 11/33 15/83 |
| 8,726,441 | B1 * | 5/2014 | Colasanti | A47L 11/33 15/46 |
| 2002/0129462 | A1 * | 9/2002 | Matusz | A47L 9/0488 15/384 |

FOREIGN PATENT DOCUMENTS

| | | | |
|---|---|---|---|
| CN | 108903798 | A | 11/2018 |
| CN | 108968799 | A | 12/2018 |
| CN | 108968800 | A | 12/2018 |
| JP | 2002095614 | A | 4/2002 |
| JP | 2003125991 | A | 5/2003 |
| JP | 2006312066 | A | 11/2006 |
| JP | 2014512246 | A | 5/2014 |
| JP | 2014212846 | A | 11/2014 |

OTHER PUBLICATIONS

OA for JP application 2019-566356.
International Search Report dated Jul. 24, 2019 in the corresponding International Application No. PCT/CN2019/078666.

* cited by examiner

ROLLER BRUSH ASSEMBLY AND CLEANING DEVICE

CROSS-REFERENCES TO RELATED APPLICATIONS

The present disclosure is a national phase application of International Application No. PCT/CN2019/078666, filed on Mar. 19, 2019, which claims the priority of Chinese Application No. 201920125075.0, filed in the Chinese Patent Office on Jan. 24, 2019, the entireties of which are herein incorporated by reference.

FIELD

The present disclosure relates to a field of cleaning appliances, and more particularly to a roller brush assembly and a cleaning device.

BACKGROUND

A cleaning device in related art, such as a sweeper, may adopt a sweeping mode of a fan sucking garbage on the ground, or a sweeping mode of a roller brush sweeping and the fan sucking simultaneously. In the two sweeping modes, a rubber strip or bristle strip is usually arranged at an edge of a suction port of the cleaning device as a sealing member to fit the ground, to seal a working area, to improve vacuum degree at the suction port and ensuring sweeping capacity of the cleaning device.

The sealing member is arranged at an edge of a rear side of the suction port along the moving direction. In the moving and sweeping process, the sealing member slidably rubs the ground. If the garbage is not sucked into the suction port in one time or dropped out of the suction port, the garbage will fall at a front of the sealing member and be pushed to move on the ground by the sealing member or be left away from the sealing member and remain in place, which will affect the cleaning effect.

SUMMARY

In the view of this, the present disclosure provides a roller brush assembly and a cleaning device to solve the problem that garbage may not be continuingly removed after not being sucked in one time.

Embodiments of the present disclosure describe a roller brush assembly for a cleaning device includes a main roller brush, an electric motor configured to drive the main roller brush to rotate to sweep a surface to be cleaned, an auxiliary roller brush driven by the main roller brush to rotate and sweep the surface to be cleaned towards the main roller brush.

In one embodiment, the auxiliary roller brush is arranged at a rear of the main roller brush along a moving direction of the cleaning device.

In one embodiment, the main roller brush includes a rotatable main roller brush body driven by the electric motor; and a sweeping member extending outward from a surface of the main roller brush body to sweep the surface to be cleaned.

In one embodiment, the auxiliary roller brush includes an auxiliary roller brush body, and a plurality of protrusions spaced apart from each other on a surface of the auxiliary roller brush body to sweep the surface to be cleaned, the sweeping member contacts and pushes the protrusion to drive the auxiliary roller brush body to rotate in a direction opposite to rotation of the main roller brush body.

In one embodiment, the auxiliary roller brush body is an elastic body and/or the protrusion is an elastic protrusion.

In one embodiment, the auxiliary roller brush also includes a plurality of flexible supports. The auxiliary roller brush body is provided with an inner cavity. The flexible support is arranged in the inner cavity, and an end of the flexible support is connected with a wall surface of the inner cavity.

In one embodiment, the other end of the flexible support is a free end. The free ends of the plurality of flexible supports are combined to form a mounting cavity, and the mounting cavity is configured to mount a connecting shaft that connects the auxiliary roller brush body.

In one embodiment, the free end is in an arc shape, and the free end of each flexible support has the same curvature.

In one embodiment, connecting points between the flexible supports and the inner cavity are distributed evenly along a circumferential direction of the inner cavity.

The present disclosure also provides a cleaning device which includes the above roller brush assembly.

In the roller brush assembly and the cleaning device provided in the present disclosure, the main roller brush is rotated to sweep the surface to be cleaned, the auxiliary roller brush is provided and rotated under the driving of the main roller brush, and the auxiliary roller brush sweeps the surface to be cleaned along the direction towards the main roller brush. In this way, the garbage that is not swept by the main roller brush or the garbage that is not sucked into the suction port by the cleaning device is swept again into the range that the main roller brush may sweep, and the main roller brush sweeps again for suction by the suction port, which avoids the problem that the garbage dropping in the process of cleaning affects the cleaning effect, to improve the cleaning quality and efficiency.

BRIEF DESCRIPTION OF THE DRAWINGS

The drawings described below are merely some embodiments of the present disclosure.

REFERENCE NUMERALS

1. roller brush assembly; 11. main roller brush; 111. main roller brush body; 112. sweeping member; 12. auxiliary roller brush; 121. auxiliary roller brush body; 122. protrusion; 124. flexible support; 125. inner cavity; 126. free end; 127. mounting cavity; 21. housing; 22. suction port.

DETAILED DESCRIPTION OF THE DISCLOSURE

Figure 1:
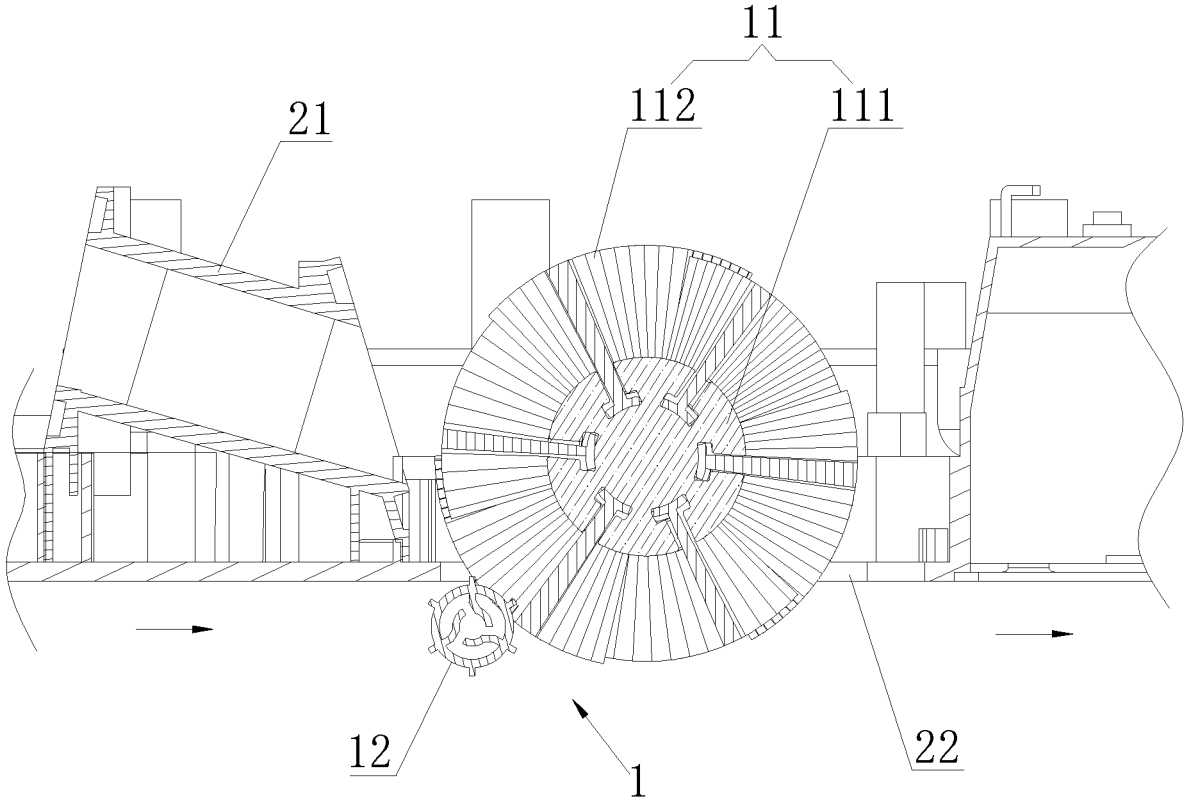
FIG. 1 is a schematic view of a roller brush assembly provided in an embodiment of the present disclosure.

As illustrated in FIG. 1, according to embodiments of the present disclosure, a roller brush assembly 1 for a cleaning device is rotatably connected to a housing 21 of the cleaning device. A bottom of the housing 21 is provided with a suction port 22, and a fan inside the cleaning device draws air to form a negative pressure at the suction port 22. The roller brush assembly 1 rotates on a surface to be cleaned to sweep garbage (such as dust, debris or water) off the surface to be cleaned, and then the fan draws the garbage into a dust collector in the cleaning device through the suction port 22.

By sweeping the surface to be cleaned with the roller brush assembly, the garbage leaves the surface to be cleaned, the garbage is more easily sucked into the suction port, to improve the cleaning quality. The meaning of sweeping refers to that the garbage leaves its attached surface under the action of force, which is not only limited to the action of force performed by a bristle, etc.

The surface to be cleaned may be a variety of surfaces that need to be cleaned, including surfaces of ground, wall, door, window, etc. Texture of the surface to be cleaned may be selected from different materials, including carpet, tile, glass, wood, bamboo, rubber, etc. The surface to be cleaned may be a flat surface or a curved surface.

As illustrated in FIG. 1, along a moving direction of the cleaning device, the positions of the roller brush assembly 1 and the suction port 22 are close or even coincide with each other, the garbage may be quickly sucked into the suction port 22 after being swept off the ground by the roller brush assembly 1, thus preventing dust from polluting the environment. In other embodiments, the position of the suction port 22 may also be adjusted to be at a front or a rear of the roller brush assembly 1, or a plurality of suction ports 22 may be arranged along the moving direction of the cleaning device, and the roller brush assembly 1 may be arranged among the plurality of suction ports 22.

As illustrated in FIG. 1, the roller brush assembly 1 includes a main roller brush 11, an electric motor configured to drive the main roller brush 11 to rotate to sweep a surface to be cleaned, and an auxiliary roller brush 12. The main roller brush 11 is mounted in a recessed cavity defining the suction port 22 at the bottom of the housing 21. A part of the main roller brush 11 is exposed outside the suction port 22 to contact the surface to be cleaned, and rotates to sweep the garbage on the surface to be cleaned under the drive of the electric motor.

The auxiliary roller brush 12 is arranged close to an edge of the suction port 22. Driven by the main roller brush 11, the auxiliary roller brush 12 rotates in a direction opposite to the rotation of the main roller brush, thus sweeping the surface to be cleaned in the direction of the main roller brush 11, and sweeping the garbage which is not swept away by the main roller brush 11 and is not sucked by the suction port 22 into the sweeping area of the main roller brush again, the garbage is sucked by the suction portion 22, which effectively solves the problem that the garbage may not be continuingly sucked after not being sucked in one time and prevents the garbage that is not sucked in one time from being pushed all the time to pollute the ground or from falling to the ground, to improve the cleaning quality and efficiency of the cleaning device.

In one embodiment, since garbage dropping from suction port 22 may be at the front and/or the rear of the main roller brush 11, the position of the auxiliary roller brush 12 may be at the front and/or the rear of the main roller brush. As illustrated in FIG. 1, the auxiliary roller brush 12 is arranged at the rear of the main roller brush 11 along the moving direction of the cleaning device. In one embodiment, the auxiliary roller brush 12 is arranged at a rear edge of the suction port 22 along a cleaning direction. Thus, in a cleaning process, the main roller brush 11 rotates clockwise to sweep the garbage backward, and the garbage is swept into the area of suction port 22 to be sucked. While the sweeping direction of the auxiliary roller brush 12 is opposite to that of the main roller brush 11, the auxiliary roller brush 12 rotates counterclockwise to sweep the garbage forward, and the garbage behind the suction port 22 is swept forward to the sweeping area of main roller brush 11 and/or sucked by the suction port 22. Therefore, the garbage after being swept by the main roller brush 11 but not being sucked by the suction port 22 or falling from the suction port 22 may be swept again by the auxiliary roller brush 12 at the rear of the main roller brush 11. The garbage is swept again to the sweeping area of the main roller brush 11, and swept again by the main roller brush 11 and sucked by the suction port 22, or swept again to be directly sucked by the suction port 22 to continuingly suck the garbage that has not been suck in one time.

In one embodiment, as illustrated in FIG. 1, the main roller brush 11 includes a rotatable main roller brush body 111 and a sweeping member 112. The main roller brush body 111 is driven by an electric motor and rotatably connected to the housing 21 through a connecting mechanism. The sweeping member 112 extends outward from a surface of the main roller brush body 111, and that is, it extends away from the main roller brush body 111. The sweeping member 112 may rotate with the main roller brush body 111. During the cleaning process, the sweeping member 112 rotates to sweep the surface to be cleaned. The sweeping member 112 may be a hard or soft brush bristle or blade, the mode of which in the surface of the main roller brush body 111 may be arranged in a plurality of ways, including wingding on the surface of the main roller brush body 111 in a "spiral" manner along a length direction of the main roller brush body 111, or linearly extending along the length direction of the main roller brush body 111. The sweeping member 112 may be spaced apart from each other in a circumferential direction of the main roller brush body 111. For example, as illustrated in FIG. 1, six groups of bristles forming the sweeping member 112 are spaced apart from each other along the circumferential direction of the main roller brush body 111. The electric motor may be arranged in the housing 21, connected with the main brush body 111 and driving the main brush body 111 to rotate.

Figure 2:
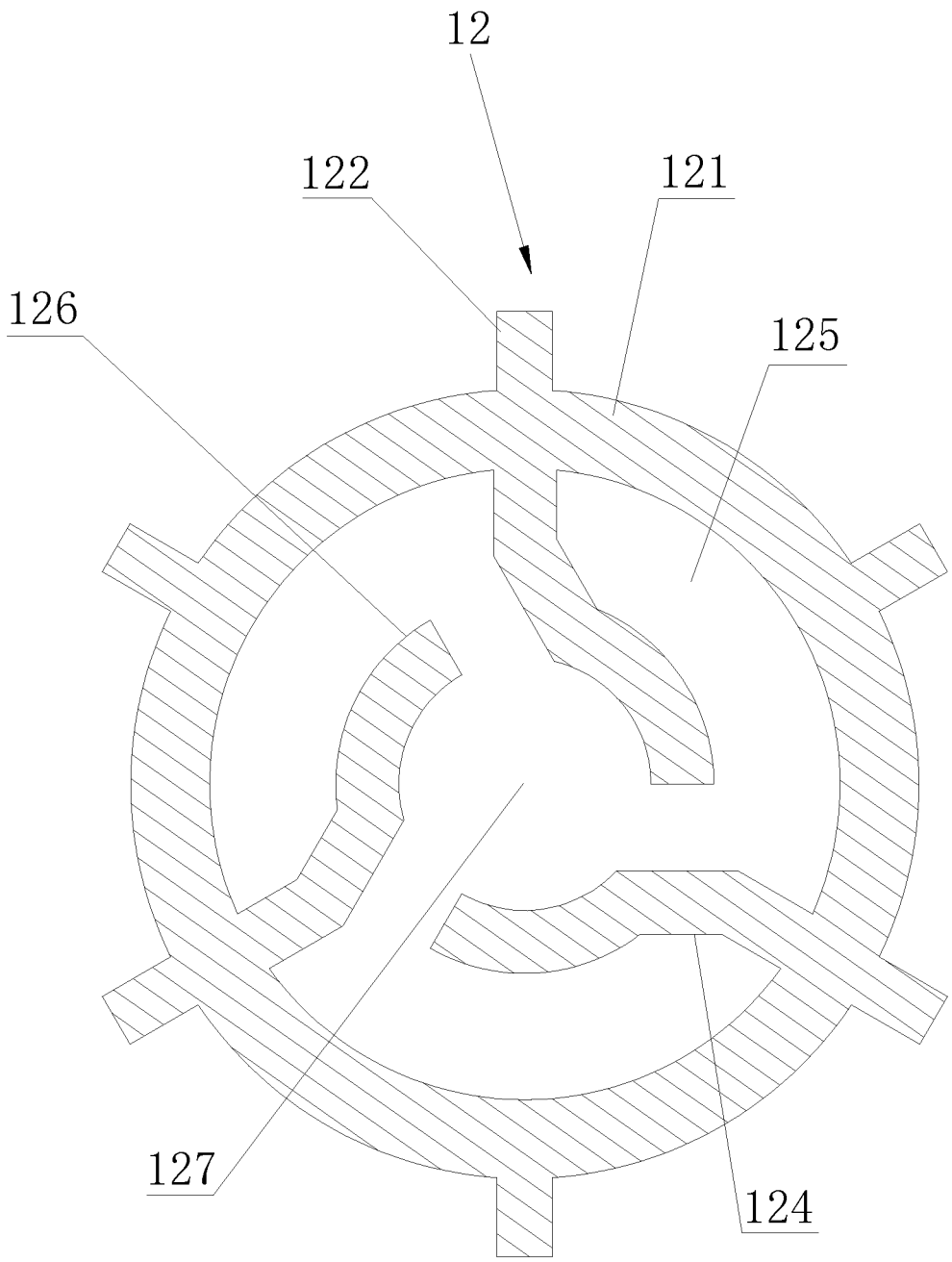
FIG. 2 is a schematic view of an auxiliary roller brush provided in an embodiment of the present disclosure.

As illustrated in FIGS. 1 and 2, the auxiliary roller brush 12 includes an auxiliary roller brush body 121 and a plurality of protrusions 122 spaced apart from each other on the surface of the auxiliary roller brush body 121 to sweep the surface to be cleaned. Each of the protrusions 122 is evenly distributed on the surface of the auxiliary roller brush body 121 along a length direction perpendicular to the auxiliary roller brush body 121, and the way of extending thereof along the length direction of the auxiliary roller brush body 121 may be a straight or curved.

In the present embodiment, each of the arranged protrusions 122 may contact with the sweeping member 112 and drive the auxiliary roller brush body 121 to rotate in the direction opposite to rotation of the main roller brush body 111 under the pushing of the sweeping member 112. In this way, the electric motor drives the main roller brush body 111 to rotate, the sweeping member 112 may follow to rotate. Since the sweeping member 112 may contact with the protrusion 122, the rotating sweeping member 112 may push the protrusion 122 and then drive the auxiliary roller brush body 121 to rotate in the direction opposite to rotation of the main roller brush body 111, and the protrusion 122 is driven to rotate synchronously during rotation of the sweeping member 112. In this way, the main roller body 111 and the auxiliary roller body 121 share a common driving member to rotate without adding any other components, thus simplifying components and saving cost. The protrusion 122 rotates under the push of the sweeping member 112. Due to the arrangement of the protrusion, it is beneficial to sweep the garbage on the surface to be cleaned, the garbage that is not sucked by the suction port 22 and falls in a sweeping area of the auxiliary roller brush 12 is swept again to the side of the main roller brush 11 and sucked again by the suction port 22, which improves the cleaning quality and efficiency.

In one embodiment, in the embodiments of the present disclosure, the auxiliary roller brush body 121 is an elastic body and/or the protrusion 122 is an elastic protrusion. The auxiliary roller brush body 121 and/or the protrusion 122 are arranged to be made of elastic material, the gap between the rear edge of the suction port 22 and the surface to be cleaned may be minimized or even closed by the elastic deformation under pressure during movement of the cleaning device, which raises vacuum degree at the suction port 22, to ensure the cleaning quality and efficiency.

In one embodiment, as illustrated in FIG. 2, in order to enhance the elastic deformation performance of the auxiliary roller brush 12, the auxiliary roller brush 12 also includes a plurality of flexible supports 124, and the term "a plurality of" means more than or equal to two. Three flexible supports are illustrated in FIG. 2. The auxiliary roller brush body 121 is provided with a hollow inner cavity 125, and the inner cavity 125 is closed in a circumferential direction and opens at both ends in an axial direction. For example, the inner cavity may be a hollow cylinder. Each flexible support 124 is arranged in the inner cavity 125, and one end of each flexible support 124 is connected with a wall surface of the inner cavity 125. In this way, an interior of the auxiliary roller brush body 121 is in a hollow structure, the auxiliary roller brush body 121 is easier to have elastic deformation under pressure and further closely fits to the surface to be cleaned, hence improving the vacuum degree at the suction port 22 and ensuring the ability of sucking the garbage.

In one embodiment, the other end of the flexible support 124 is a free end 126. Then, the elastic deformation range of the auxiliary roller brush body 121 is relatively larger in a pressed state, to ensure the fit degree with the surface to be cleaned. In other embodiments, the other end of the flexible support 124 may also be connected with each other or to the wall surface of the inner cavity 125. In embodiments of the present disclosure, the free ends 126 of a plurality of the flexible supports 124 are combined to define a mounting cavity 127, as illustrated in FIG. 4. The mounting cavity 127 is a part of the inner cavity 125. The mounting cavity 127 is configured to mount a connecting shaft that connects the auxiliary roller brush body 121. In one embodiment, a connection between the auxiliary roller brush 12 and the housing 21, the connecting shaft is used to connect the housing 21 and the auxiliary roller brush 12, and the mounting cavity 127 is used for passing the connecting shaft there through may be obtained, to connect the auxiliary roller brush body 121 with the housing 21.

In one embodiment, each free end 126 may be in an arc shape, that is, the three dimensional shape of the free end 126 is curved and have a radian, and the surface of the free end 126 is an arc surface. Moreover, the curvature of the free end 126 of each flexible support 124 is the same, and that is, the bending degree of the arc surface for each free end 126 is the same, to ensure that the shape of mounting cavity 127 formed by the combination of each free end 126 is regular and may be matched and connected with the connecting shaft. In the embodiment of the present disclosure, each free end 126 is arranged at intervals and not connected with each other, and that is, the mounting cavity 127 is not a circumferentially closed empty cavity. In other embodiments, each free end 126 may also be connected together to define a circumferentially closed empty cavity.

As illustrated in FIG. 2, connecting points of the plurality of flexible supports 124 in the inner cavity 125 and the inner cavity are distributed evenly along the circumferential direction of the inner cavity 125, each flexible support 124 may be loaded evenly and the elastic deformation of the auxiliary roller brush body 121 is even in the pressed state, to improve the working stability of the auxiliary roller brush 12. In one embodiment, as illustrated in FIG. 4, on a section that is perpendicular to the length direction of the auxiliary roller brush body 121 (the length direction refers to the direction with the largest size), each flexible support 124 extends the same distance and each protrusion 122 extends the same distance. The distance extended by the flexible support 124 is larger than the distance extended by the protrusion 122. That is, compared to a diameter of a cross section (the section in vertical length direction) of the auxiliary roller brush 121, a height of the protrusion 122 is very small, in the process of the auxiliary roller brush 12 rotating on the surface to be cleaned, the protrusion 122 may sweep the garbage on the surface to be cleaned more effectively due to its small height, thus improving the cleaning quality and efficiency.

Embodiments of the present disclosure also provide a cleaning device, which includes the above roller brush assembly 1. There are a plurality of kinds of cleaning devices, including sweeping robot, vacuum cleaners and other types.

Since the auxiliary roller brush 12 in the above roller brush assembly 1 may rotate, and its rotating direction is opposite to the rotating direction of the main roller brush 11, the garbage may be swept towards the main roller brush 11. Hence, the garbage that is swept by the main roller brush 11 but not sucked is swept again back into the area directly opposite to the suction port 22 for re-suction, which avoids the problem that the garbage dropping in the process of cleaning affects the cleaning effect, to improve the cleaning quality and efficiency. It solves the problem that the garbage may not be sucked again after it falls to the ground without being sucked in one time by the suction port in the arrangement of a traditional cleaning device.

What is claimed is:

1. A roller brush assembly for a cleaning device, comprising:

a main roller brush;

an electric motor configured to drive the main roller brush to rotate to sweep a surface to be cleaned; and an auxiliary roller brush driven by the main roller brush to rotate and sweep the surface to be cleaned towards the main roller brush;

wherein the main roller brush comprises:

a rotatable main roller brush body driven by the electric motor; and a sweeping member extending outward from a surface of the rotatable main roller brush body to sweep the surface to be cleaned;

wherein the auxiliary roller brush comprises:

an auxiliary roller brush body; and a plurality of protrusions spaced apart from each other on a surface of the auxiliary roller brush body to sweep the surface to be cleaned;

wherein the sweeping member contacts and pushes a protrusion to drive the auxiliary roller brush body to rotate in a direction opposite to rotation of the main roller brush body.

2. The roller brush assembly according to claim 1, wherein the auxiliary roller brush is arranged at a rear of the main roller brush along a moving direction of the cleaning device.

3. The roller brush assembly according to claim 1, wherein the auxiliary roller brush body is an elastic body and the protrusion is an elastic protrusion.

4. The roller brush assembly according to claim 1, wherein the auxiliary roller brush further comprises a plurality of flexible supports, the auxiliary roller brush body is provided with an inner cavity, the flexible support is arranged in the inner cavity, and a first end of the flexible support is connected with a wall surface of the inner cavity.

5. The roller brush assembly according to claim 4, wherein a second end of a flexible support is a free end, wherein free ends of the plurality of flexible supports are combined to define a mounting cavity, and the mounting cavity is configured to mount a connecting shaft connected to the auxiliary roller brush body.

6. The roller brush assembly according to claim 5, wherein the free end is in an arc shape, and curvature of the free ends of each flexible support are the same.

7. The roller brush assembly according to claim 4, wherein connecting points of the flexible supports and the inner cavity are distributed evenly along a circumferential direction of the inner cavity.

8. A cleaning device, comprising:

a roller brush assembly, comprising:

a main roller brush;

an electric motor configured to drive the main roller brush to rotate to sweep a surface to be cleaned; and an auxiliary roller brush driven by the main roller brush to rotate and sweep the surface to be cleaned towards the main roller brush;

wherein the main roller brush comprises:

a rotatable main roller brush body driven by the electric motor; and a sweeping member extending outward from a surface of the rotatable main roller brush body to sweep the surface to be cleaned;

wherein the auxiliary roller brush comprises:

an auxiliary roller brush body; and a plurality of protrusions spaced apart from each other on a surface of the auxiliary roller brush body to sweep the surface to be cleaned;

wherein the sweeping member contacts and pushes a protrusion to drive the auxiliary roller brush body to rotate in a direction opposite to rotation of the main roller brush body.

9. The cleaning device according to claim 8, wherein the auxiliary roller brush is arranged at a rear of the main roller brush along a moving direction of the cleaning device.

10. The cleaning device according to claim 8, wherein the auxiliary roller brush body is an elastic body and the protrusion is an elastic protrusion.

11. The cleaning device according to claim 8, wherein the auxiliary roller brush further comprises a plurality of flexible supports, the auxiliary roller brush body is provided with an inner cavity, the flexible support is arranged in the inner cavity, and a first end of the flexible support is connected with a wall surface of the inner cavity.

12. The cleaning device according to claim 11, wherein a second end of a flexible support is a free end, wherein free ends of the plurality of flexible supports are combined to define a mounting cavity, and the mounting cavity is configured to mount a connecting shaft connected to the auxiliary roller brush body.

13. The cleaning device according to claim 12, wherein the free end is in an arc shape, and curvature of the free ends of each flexible support are the same.

14. The cleaning device according to claim 11, wherein connecting points of the flexible supports and the inner cavity are distributed evenly along a circumferential direction of the inner cavity.

* * * * *